US005595149A

United States Patent [19]

Speil et al.

[11] Patent Number: 5,595,149

[45] Date of Patent: Jan. 21, 1997

[54] METHOD OF FIRST FILLING OF A HYDRAULIC VALVE ACTUATING DEVICE

[75] Inventors: Walter Speil, Ingolstadt; Dieter Schmidt, Nürnberg, both of Germany

[73] Assignee: Ina Walzlager Schaeffler KG, Germany

[21] Appl. No.: 589,480

[22] Filed: Jan. 22, 1996

[30] Foreign Application Priority Data

Feb. 4, 1995 [DE] Germany ..... 195 03 699.9

[51] Int. Cl.[6] ..... F01L 1/245; F01L 31/00

[52] U.S. Cl. ..... 123/90.55; 123/90.46; 123/90.37; 74/559; 74/569

[58] Field of Search ..... 123/90.33, 90.35, 123/90.36, 90.37, 90.45, 90.46, 90.52, 90.55, 90.59; 74/559, 569

[56] References Cited

U.S. PATENT DOCUMENTS

| | | | |
|---|---|---|---|
| 3,477,416 | 11/1969 | Line | 123/90.35 |
| 4,392,462 | 7/1983 | Lesher | 123/90.55 |
| 4,463,713 | 8/1984 | Barale | 123/90.55 |
| 4,615,440 | 10/1986 | Downing | 123/90.55 |
| 4,735,197 | 4/1988 | Ishida et al. | 123/90.55 |
| 5,029,560 | 7/1991 | Watanabe | 123/90.55 |
| 5,183,016 | 2/1993 | Budde | 123/90.55 |

FOREIGN PATENT DOCUMENTS

| | | |
|---|---|---|
| 0395311 | 10/1990 | European Pat. Off. . |
| 7626878 | 2/1977 | Germany . |
| 3706006 | 9/1988 | Germany . |
| 3838501 | 5/1990 | Germany . |

*Primary Examiner*—Weilun Lo
*Attorney, Agent, or Firm*—Bierman & Muserlian

[57] ABSTRACT

A method of leakproof first filling of a hydraulic valve actuating tappet (1) with hydraulic oil, a) comprising almost completely filling the central oil reservoir (7) together with a high pressure chamber (18) situated axially between the bottom (11) of the pressure piston (10) and the guide sleeve (5), and the annular oil reservoir (17), with hydraulic oil, and b) filling at least the supply bore (19) leading to the annular oil reservoir (17), with a lubricating grease or a pasty material (20) which is flow-resistant at ambient temperature.

13 Claims, 4 Drawing Sheets

METHOD OF FIRST FILLING OF A HYDRAULIC VALVE ACTUATING DEVICE

STATE OF THE ART

Figure 1:
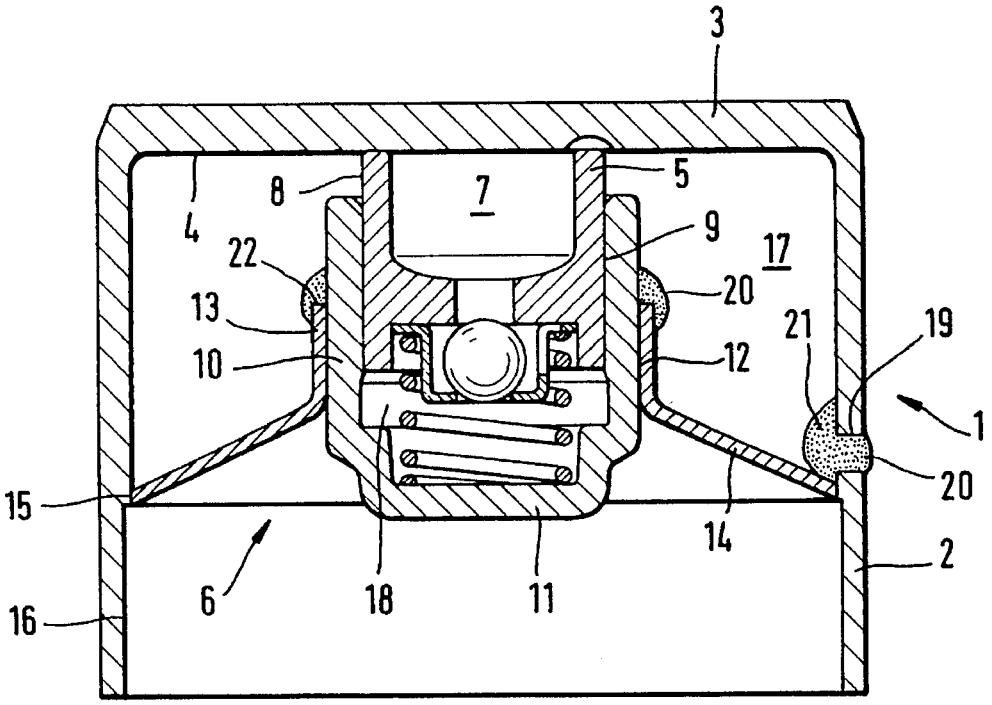

A method of leakproof first filling of a hydraulic valve actuating tappet with hydraulic oil, said tappet comprising a hollow cylindrical jacket closed at one end by a disc-shaped bottom which is contacted by a control cam, a hollow cylindrical guide sleeve extending concentric with the jacket from an undersurface of the bottom and enclosing a central oil reservoir while an outer peripheral surface of the guide sleeve extends in a bore of an axially displaceable pressure piston comprising a bottom oriented towards a gas exchange valve and an outer peripheral surface surrounded by an axial extension of an annular guiding element which is affixed at an outer edge to an inner peripheral surface of the jacket and extends radially inwards from said outer edge to delimit thereabove an annular oil reservoir which can be filled with hydraulic oil through at least one supply bore in the jacket is known, for example, from EP-A 03 95 311 which likewise comprises a hollow cylindrical jacket closed at one end by a disc-shaped bottom. A concentrically arranged guide sleeve of a clearance compensation element bears against an undersurface of the bottom. An oil reservoir is arranged in a bore of the guide sleeve and can be filled with hydraulic oil from a further, annular oil reservoir through an overflow recess in the undersurface of the bottom. An annular membrane with a central hole is disposed near the edge of the bore and is intended to prevent an undesired emptying of the oil reservoir of the guide sleeve, for example, during transport of the at least partly filled tappet or when the engine is in an inclined position or the like.

A disadvantage of this generic type of valve tappet is that, due to the perforated membrane, an adequate refilling of the central oil reservoir is not guaranteed under all conditions of operation of the internal combustion engine. It is also reliably assured, for instance, in a partly filled valve tappet, i.e. when only the central oil reservoir is filled with hydraulic oil before assembly and transportation, that the entire quantity of hydraulic oil contained therein remains in place. Rather, undesired losses must be expected, with a first consequence that the high pressure chamber of the clearance compensation element is no longer adequately filled with hydraulic oil during subsequent operation of the tappet which results in an undesired suction of air and a detrimental compressibility of the tappet during the high pressure phase thereof and in noise development in the tappet. Further, this involuntary escape of hydraulic oil is disadvantageous for the handling of the valve tappet and in the extreme case, can lead to environmental pollution. Furthermore, the membrane itself, as also its mounting, is relatively cost-intensive.

Valve actuating tappets designed to be hydraulically autarkic are also known to persons skilled in the art. Such tappets effect hydraulic compensation of clearance without an external supply of hydraulic medium. However, a disadvantage of most of these tappets is that, due to their hydraulically autarkic mode of operation, their weight is unnecessarily increased and this leads to an increase in costs. Moreover, a large number of such tappets have not proved to be operationally reliable over the entire lifetime of the internal combustion engine. Other prior art solutions include disposing of an annular seal in the region of the pressure piston and its guide sleeve to prevent leakage of hydraulic medium during transportation of the tappet through a gap existing between the pressure piston and the guide sleeve.

OBJECTS OF THE INVENTION

It is an object of the invention to solve the problems of hydraulically autarkic tappets being too expensive and the other solutions described herein are not suited for an effective and reliable prevention of leakage of hydraulic medium from the tappet during its transportation after a first filling with hydraulic medium up to the time of initial operation of the internal combustion engine.

This and other objects and advantages of the invention will become obvious from the following detailed description.

THE INVENTION

The novel method of the invention of leakproof first filling of a hydraulic valve actuating tappet (1) with hydraulic oil, said tappet comprising a hollow cylindrical jacket (2) closed at one end by a disc-shaped bottom (3) which is contacted by a control cam, a hollow cylindrical guide sleeve (5) extending concentric with the jacket (2) from an undersurface (4) of the bottom (3) and enclosing a central oil reservoir (7) while an outer peripheral surface (8) of the guide sleeve (5) extends in a bore (9) of an axially displaceable pressure piston (10) comprises a bottom (11) oriented towards a gas exchange valve and an outer peripheral surface (12) surrounded by an axial extension (13) of an annular guiding element (14) which is affixed at an outer edge (15) to an inner peripheral surface (16) of the jacket (2) and extends radially inwards from said outer edge (15) to delimit thereabove an annular oil reservoir (17) which can be filled with hydraulic oil through at least one supply bore (19) in the jacket (2), a) comprising almost completely filling the central oil reservoir (7) together with a high pressure chamber (18) situated by axially between the bottom (11) of the pressure piston (10) and the guide sleeve (5), and the annular oil reservoir (17), with hydraulic oil, and b) filling at least the supply bore (19) leading to the annular oil reservoir (17), with a lubricating grease or a pasty material (20) which is flow-resistant at ambient temperature.

By providing a method for the first filling of a tappet comprising a first step of almost completely filling the central oil reservoir together with a high pressure chamber situated axially between the bottom of the pressure piston and the guide sleeve, as well as the annular oil reservoir, with hydraulic oil, and a further step of filling at least the supply bore leading to the annular oil reservoir, with a lubricating grease or a pasty material which is flow-resistant at ambient temperature, the object of the invention is achieved.

The invention also proposes methods for solving the problems described herein in other valve actuating elements. Due to the fact that at least the supply bore leading to the annular oil reservoir is sealed by the sealing means of the invention, the detrimental losses of hydraulic medium encountered in conventional solutions are eliminated. Such losses of hydraulic medium after the first filling of the valve actuating tappet are caused, for example, by temperature variations, transport losses and/or due to axial displacements of the pressure piston. Furthermore, rattling noises generally produced on initial operation of the engine are also eliminated because the valve actuating tappet of the invention is adequately filled with hydraulic medium.

A further development of the invention concerns the use of a lubricating grease or a pasty material which starts to flow upward at an operating temperature of approximately 50° C. to 60° C. and at the same time becomes soluble in the hydraulic medium. Thus, it is assured by a simple means that in the presence of hydraulic medium, the sealing material dissolves with increasing operating temperature without residues, and it is then possible to adequately top up the valve actuating tappet with hydraulic medium.

Other advantageous embodiments of the invention relate to a sealing of further, or of all connecting cross-sections between the outer atmosphere and the interior of the valve actuating tappet, or, the case being given, between the outer atmosphere and the interior of an assembly such as a support element for a rocker arm comprising a hydraulic clearance compensation element. In effect, the invention advantageously provides for the sealing of an annular gap between the pressure piston of the clearance compensation element and its guiding element.

Another embodiment of the invention also concerns filling a cam-remote portion of the annular oil reservoir at least partially with the sealing material. In all events, what is important for the invention is that the amount of lubricating grease or pasty material extending from the supply bore into the tappet interior is sufficient to compensate the volume variations of the hydraulic medium in the annular oil reservoir so that no hydraulic medium can "break through" into the open through the supply bore.

Further, the buffer action of the material must also be such that an in-flow is prevented even in the presence of a negative alteration of volume. Advantageously, the sealing material can also be utilized to secure the pressure piston against loss, thus eliminating, in some cases, the necessity of using material retaining devices.

Other features of the invention concern the formation of a reservoir for the sealing material, for example, by a cup-shaped or otherwise configured recess in an existing hydraulic medium canal, or a reservoir extending from the tappet jacket or bottom. A partial filling with the sealing material before completion of assembly of the individual components of the valve actuating tappet is also conceivable. The invention thus relates to all types of hydraulic valve actuating elements in which a leakage of a pre-filled quantity of hydraulic medium is to be prevented till installation of the elements and initial operation of the internal combustion engine. Thus, the invention can also be used in bridge-type valve actuating elements, hydraulic switching tappets, disconnectable support elements and the like. The invention likewise covers valve actuating tappets having different internal structures, for example, with respect to the mutual arrangement of the pressure piston and the guide sleeve, or the configuration of the annular guiding element etc. It is thus also within the scope of the invention to configure the guiding element, for example, with crossbars or as a solid element. A suitable buffer material, for example, is a grease with the commercial designation ELF DAG 1 or Shell Alvania R3.

REFERRING NOW TO THE DRAWINGS

Figure 3:
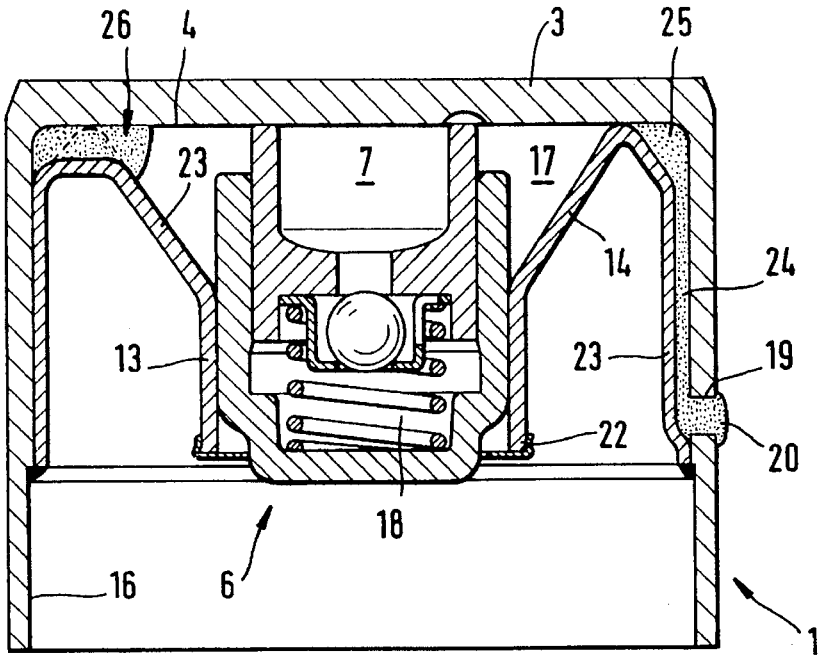
Figure 4:
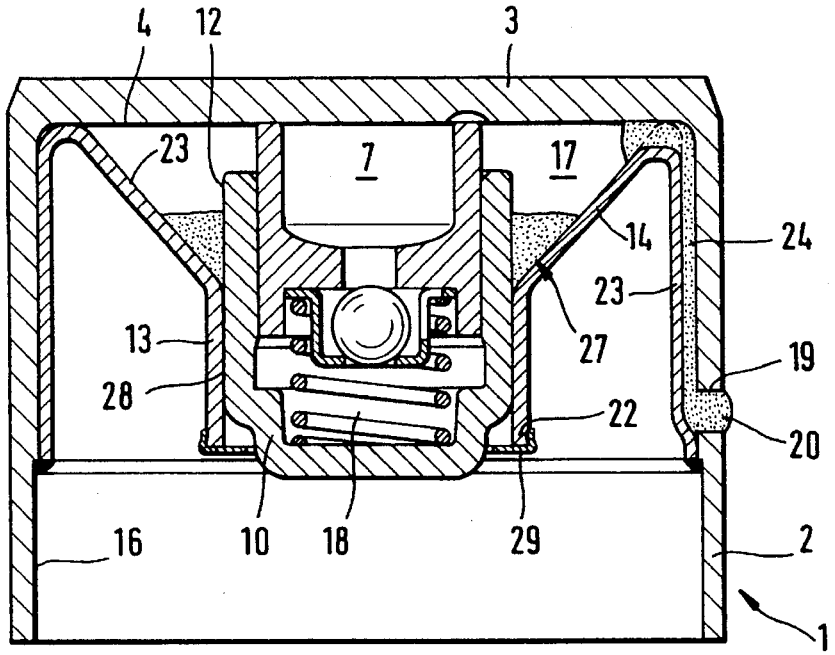
Figure 4A:
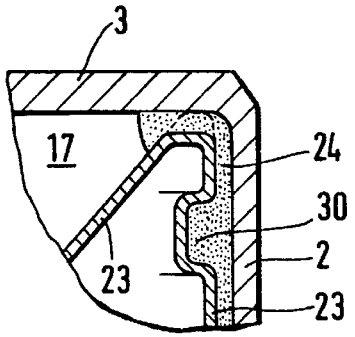
Figure 5:
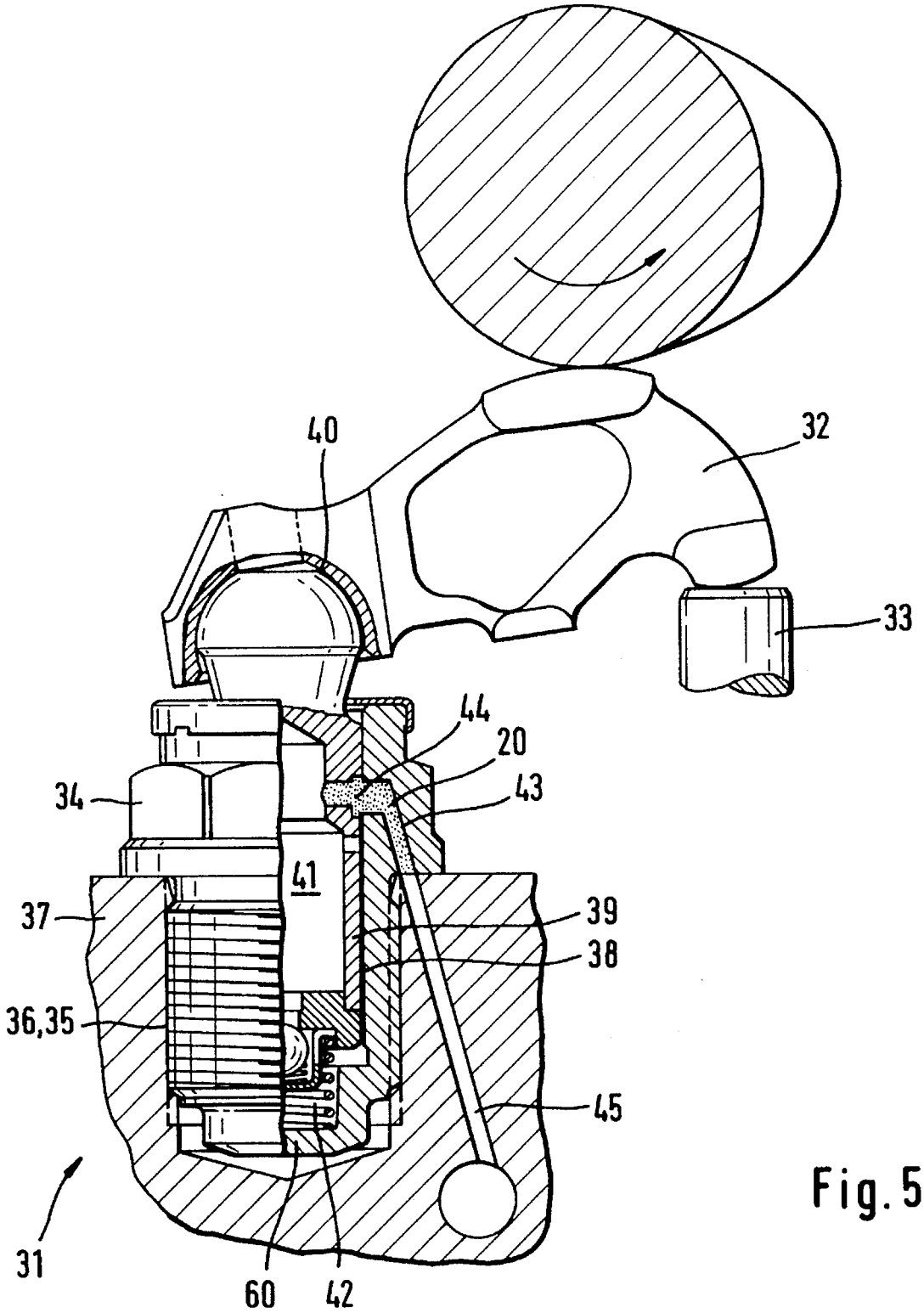
Figure 6:
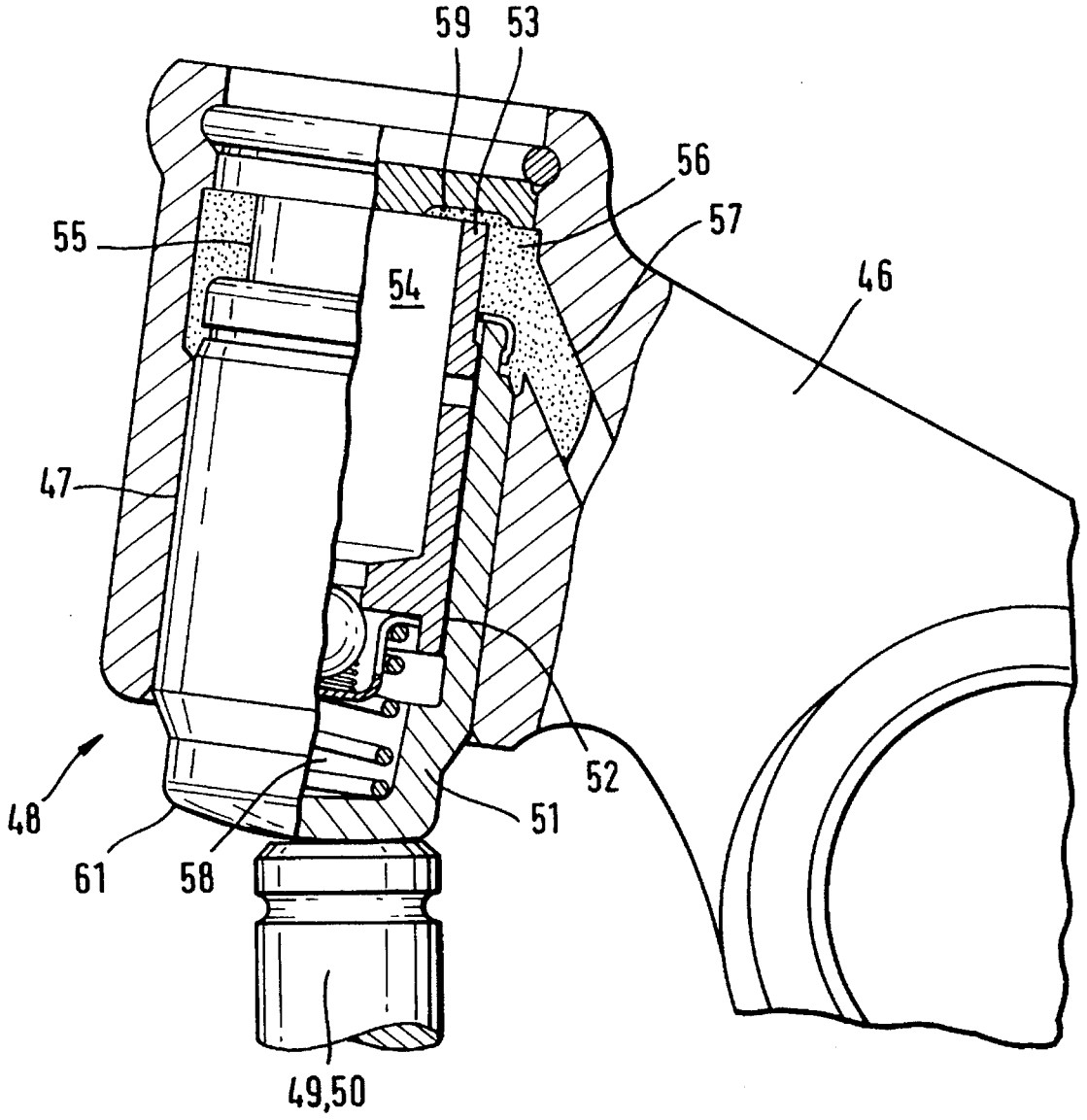

FIGS. 1–4*a* illustrate hydraulic valve actuating tappets of different configurations, FIG. 5 illustrates a hydraulic support element, and FIG. 6 shows an insertion element for a rocker arm.

FIG. 1 shows a hydraulic valve actuating tappet (1) comprising a hollow cylindrical jacket (2) closed at one end by a disc-shaped bottom (3) loaded by a control cam, not shown, in stroke direction. A hollow cylindrical guide sleeve (5) extends concentric with the jacket (2) from an undersurface (4) of the bottom (3). The guide sleeve (5) is an integral part of a hydraulic clearance compensation element (6) and encloses a central oil reservoir (7). An outer peripheral surface (8) of the guide sleeve (5) extends at least partially in a bore (9) of an axially displaceable pressure piston (10) which comprises a bottom (11) oriented towards an end of a gas exchange valve, not shown. An outer peripheral surface (12) of the pressure piston (10) is partially surrounded by an axial extension (13) of an annular guiding element (14) which is connected at its outer edge (15) to an inner peripheral surface (16) of the jacket (2). Together with the bottom (3), the guiding element (14) defines an annular oil reservoir (17) extending therebetween, while between the guide sleeve (5) and the bottom (11) of the pressure piston (10) there is arranged a high pressure chamber (18).

To prevent a leakage of pre-filled hydraulic medium from the oil reservoirs (7) and (17) till the installation of the valve actuating tappet in the internal combustion engine and the initial operation of the latter, at least one supply bore (19) leading through the jacket (2) into the annular oil reservoir (17) is sealed, after filling of the hydraulic medium, with a lubricating grease or a pasty material (20) which does not flow at ambient temperature. To compensate volume variations of the enclosed hydraulic medium, a further volume (21) of sealing material (20), corresponding at least to the volume difference, is disposed in the direction of flow of the hydraulic medium adjacent to the sealing material (20) of the supply bore (19).

Figure 2:
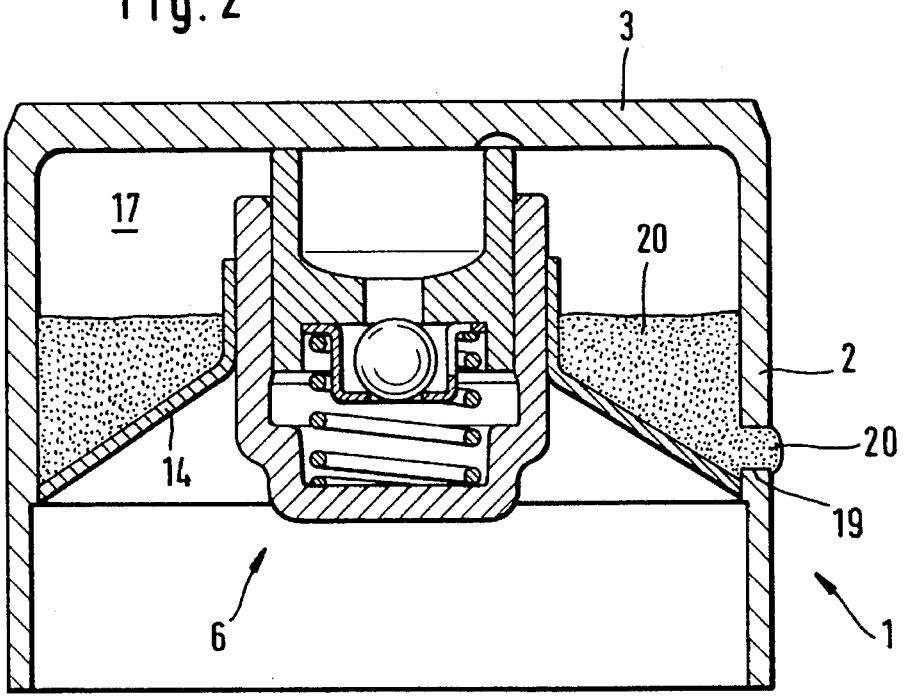

As can further be seen in FIG. 1, it is also possible to provide the lubricating grease or the pasty material (20) in a region of an edge (22) of the axial extension (13) facing the cam, and on a part of the pressure piston (10) situated in this region. This measure can be additionally used also in the embodiment shown in FIG. 2. FIG. 2 illustrates that the lubricating grease or material (20) can be filled into the region above the guiding element (14) at least up to the run-out level of the supply bore (19) or higher.

FIG. 3 shows a valve actuating tappet (1) whose clearance compensation element (6) is guided by an axial extension (13) of a funnel-shaped annular guiding element (23) extending from the bottom (3). This guiding element (23) also bears circumferentially against the inner peripheral surface (16) of the jacket (2), reaches upwards to the undersurface (4) of the bottom (3) to then extend, as described above, inwards in the form of a funnel. Starting from the supply bore (19), there is formed in the guiding element (23), at least one hydraulic medium canal (24) extending towards the bottom (3).

In FIG. 3, this canal (24) opens in the region of the bottom (3) into an annular canal (25) which has an offset access (26) to the oil reservoir (17). In the embodiment of FIG. 4, the canal (24) opens directly into the oil reservoir (17). According to the invention, after a first filling of the oil reservoirs (7), (17) and the high pressure chamber (18) with hydraulic medium, the supply bore (19) together with the canal (24), or with a part thereof, can be sealed with the lubricating grease or the pasty material (20). If necessary, the annular canal (25) may likewise be sealed with the material (20).

Referring again to FIG. 4, it can be seen that it is also possible to fill the annular portion (27) of the annular oil reservoir (17) situated furthest away from the cam with the sealing material (20). This effectively prevents an emptying of the oil reservoir (17) through the annular gap (28) existing between the pressure piston (10) and the axial extension (13). However, it is also conceivable even in the embodiments of FIGS. 3 and 4 to seal only the region directly adjacent the supply bore (19) with the sealing material (20). If the additional measure of FIG. 4 pertaining to the annular portion (27) is implemented, it is possible in certain circumstances to dispense with an annular retaining element (29) for fixing the pressure piston (10).

FIG. 4*a* illustrates a simple means for forming a reservoir for the sealing material (20) consisting in arranging at least one cup-shaped recess (30) between the jacket (2) and the guiding element (23) in the region of the canal (24). However, to store the required quantity of lubricating grease or pasty material (20), it is also conceivable to enlarge the cross-section of the canal (24).

FIG. 5 shows a hydraulic support element (31) for a finger lever (32), one end of which acts in stroke direction on an end of a valve shaft (33) of a gas exchange valve. The support element (31) comprises a hollow cylindrical housing (34) which bears by its outer peripheral surface (35) against a bore (36) of a cylinder head (37). An axially displaceable pressure piston (39) is arranged in a bore (38) of the housing (34). An end (40) of the pressure piston (39) cooperates with a second end of the finger lever (32). Transport losses of hydraulic medium from the hydraulic support element (31), which can also be delivered together with the finger lever (32), can be prevented by filling the lubricating grease or the pasty material (20) into a supply bore (43) provided in the housing and if, necessary, into an annular space (44) surrounding the pressure piston (39), after the reservoir (41) and the high pressure chamber (42) of the support element (31) have been filled for the first time with hydraulic medium. On initial operation of the support element (31), the increasing operating temperature of the pressure medium present in a supply conduit (45) in the cylinder head (37) causes the material (20) to be dissolved or flushed away.

FIG. 6 shows a cam follower in the form of a rocker arm (46). One end of the rocker arm (46) comprises a receiving bore (47) in which is arranged a clearance compensation element (48) of a known type comprising a pressure piston (51) which cooperates with one end (49) of a valve shaft (50) of a gas exchange valve. The outer peripheral surface of the pressure piston (51) extends in the receiving bore (47), while in a bore (52) of the pressure piston (51) is arranged a guide sleeve (53) which defines, in its interior, a central oil reservoir (54). An annular space (56) for hydraulic medium extends in the head region of the clearance compensation element (48) between an outer peripheral surface (55) of the guide sleeve (53) and the bore (47). The rocker arm (46) further comprises a cross-bore (57) which opens at one end into the annular space (56). The cross-bore (57) is supplied with hydraulic medium, in a manner not shown, for example via the pivot mounting of the rocker arm (46). Being given that in this case too, the central oil reservoir (54) and a high pressure chamber (58) are pre-filled with hydraulic medium, the next step is to fill at least the annular space (56) with the lubricating grease or the pasty material (20). It is advantageous to likewise seal an overflow recess (59) leading from the annular space (56) to the oil reservoir (54) and/or also inlet-side end regions of the cross-bore (57) with this material. Thus, as described above, it is assured by simple means that the enclosed hydraulic medium remains to the largest possible extent in the clearance compensation element (48) until the initial operation of the device.

Various modifications of the method of the invention may be made without departing from the spirit or scope thereof and it is to be understood that the invention is intended to be limited only as defined in the appended claims.

What we claim is:

1. A method of leakproof first filling of a hydraulic valve actuating tappet (1) with hydraulic oil, said tappet comprising a hollow cylindrical jacket (2) closed at one end by a disc-shaped bottom (3) which is contacted by a control cam, a hollow cylindrical guide sleeve (5) extending concentric with the jacket (2) from an undersurface (4) of the bottom (3) and enclosing a central oil reservoir (7) while an outer peripheral surface (8) of the guide sleeve (5) extends in a bore (9) of an axially displace-able pressure piston (10) comprising a bottom (11) oriented towards a gas exchange valve and an outer peripheral surface (12) surrounded by an axial extension (13) of an annular guiding element (14) which is affixed at an outer edge (15) to an inner peripheral surface (16) of the jacket (2) and extends radially inwards from said outer edge (15) to delimit thereabove an annular oil reservoir (17) which can be filled with hydraulic oil through at least one supply bore (19) in the jacket (2), a) comprising almost completely filling the central oil reservoir (7) together with a high pressure chamber (18) situated axially between the bottom (11) of the pressure piston (10) and the guide sleeve (5), and the annular oil reservoir (17), with hydraulic oil, and b) filling at least the supply bore (19) leading to the annular oil reservoir (17), with a lubricating grease or a pasty material (20) which is flow-resistant at ambient temperature.

2. The method of claim 1 wherein a further volume (21) of the lubricating grease or the pasty material (20) is disposed in a region of the valve actuating tappet (1) immediately following the supply bore (19) in the flow direction of the hydraulic oil, said further volume (21) being larger, in itself or together with a volume of the lubricating grease or the pasty material (20) sealing the supply bore (19), than a difference in volume of the enclosed hydraulic oil caused by temperature variations, leakage or axial displacements of the pressure piston (10) relative to the guide sleeve (5).

3. The method of claim 2 for a hydraulic valve actuating tappet (1) in which the annular guiding element (14) extends in funnel-shape towards an axial extension (13) thereof facing in the cam direction, comprising completely filling a portion of the annular oil reservoir (17) situated immediately above the guiding element (14) in cam direction with the lubricating grease or the pasty material (20) so that this lubricating grease or pasty material (20) extends at least up to or higher than a run-out level of the supply bore (19).

4. The method of claim 1 wherein the lubricating grease or the pasty material (20) is disposed in ring-shape in a region of an edge (22) of the axial extension (13) facing the cam, and on a portion of the outer peripheral surface (8) of the pressure piston (10).

5. The method of claim 3 for a hydraulic valve actuating tappet (1) in which the annular guiding element (14) bears against the inner peripheral surface (16) of the jacket (2) and extends partly up to the undersurface (4) of the bottom (3) and partly to near said undersurface (4) to continue in funnel-shape away from the cam to form the axial extension (13) which comprises an edge (22) facing away from the cam, there being formed in the guiding element (14) at least one hydraulic oil canal (24) extending from the supply bore (19) towards the cam, which canal (24) opens in an edge region between the bottom (3) and the jacket (2) into an annular canal (25) and communicates with the annular oil reservoir (17) via a circumferentially offset access (26), or opens directly into the annular oil reservoir (17), wherein at least the canal (24) extending towards the cam, or this canal (24) and the annular canal (25) are filled with the lubricating grease or the pasty material (20).

6. The method of claim 5 wherein an annular portion (27) of the annular oil reservoir (17) situated furthest away from the cam between the outer peripheral surface (12) of the pressure piston (10) and the guiding element (14) is filled with the lubricating grease or the pasty material (20).

7. The method of claim 5 wherein the canal (24) comprises at least one cup-shaped recess (30).

8. A method of leakproof first filling of a hydraulic support element (31) with hydraulic oil, said support element (31) comprising a hollow cylindrical housing (34) arranged with its outer peripheral surface (35) in a receiving bore (36), while in a bore (38) of the housing (34) there is arranged an axially displaceable pressure piston (39) comprising an end (40) which cooperates with an end of a finger lever (32), comprising a) almost completely filling a central oil reservoir (41) of the pressure piston (39) together with a high pressure chamber (42) situated between the piston (39) and a bottom (60) of the housing (34) with hydraulic oil, and b) filling at least one of a supply bore (43) arranged in the housing (34) and an annular space (44) surrounding the pressure piston (39) with a lubricating grease or a pasty material (20) which is flow-resistant at ambient temperature.

9. A method of leakproof first filling of a hydraulic clearance compensation element (48) of a cam follower with hydraulic oil, said clearance compensation element (48) comprising a pressure piston (51) cooperating with an end (49) of a valve shaft (50), an outer peripheral surface of said pressure piston (51) extending axially displaceable in a receiving bore (47) of a rocker arm (46), while in a bore (52) of the pressure piston (51) is arranged a guide sleeve (53) surrounding a central oil reservoir (54), and between an outer peripheral surface (55) of the guide sleeve (53) and the receiving bore (47) of the rocker arm (46) there is arranged an annular space (56) for hydraulic oil which is connected through at least one cross-bore (57) through the rocker arm (46) with a supply inlet, comprising a) almost completely filling the central oil reservoir (54) and a high pressure chamber (58) situated axially between a bottom (61) of the pressure piston (51) and the guide sleeve (53) with hydraulic oil, and b) filling at least the annular space (56) with a lubricating grease or a pasty material (20) which is flow-resistant at ambient temperature.

10. The method of claim 9 wherein at least one of a region of an overflow recess (59) leading from the annular space (56) to the central oil reservoir (54) of the clearance compensation element (48) and an inlet-side end regions of the cross-bore (57) of the rocker arm (46) are filled with the lubricating grease or the pasty material (20).

11. The method of claim 1 wherein the lubricating grease or the pasty material (20) starts to flow above an operating temperature of approximately 50° to 60° C. and at the same time becomes soluble in the hydraulic oil.

12. The method of claim 8 wherein the lubricating grease or the pasty material (20) starts to flow above an operating temperature of approximately 50° to 60° C. and at the same time becomes soluble in the hydraulic oil.

13. The method of claim 9 wherein the lubricating grease or the pasty material (20) starts to flow above an operating temperature of approximately 50° to 60° C. and at the same time becomes soluble in the hydraulic oil.

* * * * *